US006005591A

United States Patent [19]

Ogura et al.

[11] Patent Number: 6,005,591

[45] Date of Patent: Dec. 21, 1999

[54] METHOD AND APPARATUS FOR INCREASING VIDEO DATA BANDWIDTH BY COMPARING VIDEO DATA FOR REDUNDANCY

[75] Inventors: Akihiro Ogura; Masaki Oie, both of Sagamihara, Japan

[73] Assignee: International Business Machines Corp., Armonk, N.Y.

[21] Appl. No.: 08/617,713

[22] Filed: Apr. 1, 1996

[30] Foreign Application Priority Data

Mar. 31, 1995 [JP] Japan ..... 7-076152

[51] Int. Cl.[6] ..... G09G 5/36

[52] U.S. Cl. ..... 345/509; 345/515; 345/514; 345/526

[58] Field of Search ..... 395/501, 509, 395/511, 514, 515, 520, 523, 526; 345/189, 190, 202, 203, 501, 502, 503, 520, 521, 526, 507, 186, 509, 515, 516, 514

[56] References Cited

U.S. PATENT DOCUMENTS 5,450,130 9/1995 Foley ..... 348/391

5,526,025 6/1996 Selwan et al. ..... 345/200

*Primary Examiner*—John E. Breene
*Assistant Examiner*—U. Chauhan
*Attorney, Agent, or Firm*—Daniel E. McConnell

[57] ABSTRACT

This invention relates to a video graphic control method and controller for sending to a display device graphic data from a processing device, and the object thereof is to provide a video graphic controller that increases the bandwidth available to a graphic engine or CPU without increasing power consumption or manufacturing costs, even when used with a conventional frame memory. A video graphic controller for controlling video data by storing the video data from a CPU 4 in a frame memory 18 and causing the frame memory 18 to output the data to a display device 30 uses a video data comparison means 20 to compare a piece of video data stored in the N-th address of the frame memory 18 to another piece of video data stored in the N−1-th address in order to determine whether the two pieces of data match, and if the two pieces of data match, outputs to the display device 30 the piece of video data stored in the N−1-th address instead of the piece of video data stored in the N-th address.

8 Claims, 3 Drawing Sheets

"Prior Art"

METHOD AND APPARATUS FOR INCREASING VIDEO DATA BANDWIDTH BY COMPARING VIDEO DATA FOR REDUNDANCY

RELATED APPLICATIONS

This application claims priority from Application Ser. No. 7-76152 filed in Japan on Mar. 31, 1995.

BACKGROUND OF THE INVENTION

The present invention relates to a video graphic control method and controller for sending graphic data from a processing device to a display device.

A conventional video graphic controller used to display video graphic data on a display device such as a liquid crystal device (LCD) in response to an instruction from a central processing unit (CPU) such as a personal computer (PC) is described with reference to FIG. 4 of the figures identified hereinafter.

A video graphic controller 2 is located between a central processing unit 4 and a frame memory 18 acting as a video storage element in order to control video data. The CPU 4 is connected to a bus interface unit 6 in the video graphic controller 2. The bus interface unit 6 outputs to a memory interface unit 12 video data from the CPU 4, and outputs to a graphic engine 8 drawing information data from the CPU 4.

The graphic engine 8 generates video data from received drawing information data, and outputs the video data to the memory interface unit 12. The memory interface unit 12 reads, writes, and stores video data from, to, and in a specified address of the frame memory 18.

The frame memory 18 can store, for example, 1 megabytes (MB) of video data, and the video data in the pixels on the screen of the display device which are arranged from the upper left of the screen down to the lower right thereof is input to the frame memory 18 in the order of storage addresses. The frame memory 18 is connected to a latch 14 in the memory interface unit 12 via a 32-bit data bus, and outputs 4 pixels (32 bits) of video data at a time to the latch 14.

Four pixels of video data latched by the latch 14 are stored sequentially in a display FIFO 16, and output sequentially to a display device 30 as 1 pixel (8 bits) of video data in a first-in-first-out manner.

Graphic performance under such a conventional video graphic controller relates directly to the amount of the memory bandwidth (the transfer rate) available to a graphic engine. The amount of the memory bandwidth used by the graphic engine and CPU depends upon the resolution of a screen, range of gradation, and refresh rate of the screen.

The following methods may be used to substantially increase the memory bandwidth available to the graphic engine in order to improve graphic performance:

1. Use a high-speed memory (DRAM);
2. Use a dual port memory (VRAM); or
3. Increase the number of memory data buses.

Although these three methods serve to improve graphic performance, they have respective problems. These problems are described using Table 1 that compares conventional 32-bit frame buffer bandwidths.

TABLE 1

| Memory configuration | 32-bit DRAM | 32-bit DRAM (High Speed) | 32-bit VRAM | 64-bit DRAM |
|---|---|---|---|---|
| Memory band width (MB/s) | 100 | 140 | 100 | 200 |
| Display band width (MB/s) (1024 × 768 × 8 × 70 Hz) | 60 | 60 | 60 | 60 |
| Memory band width available to graphic engine (MB/s) (1024 × 768 × 8 × 70 Hz) | 40 | 80 | 100 | 140 |
| Cost | 1.0 | 1.5–2.0 | 2.0 | 2.0 |

The storage amount of a storage element for video display is usually about 1 megabyte (MB), and two 256K×16-bit DRAMs are used to form a DRAM with a data width of 32 bits. A DRAM with a data width of 32 bits has a memory band width (write/read rate: MB/s) of about 100 MB/s. The amount of display data required for display on an LCD or CRT (the display band width: MB/s), however, is 60 MB/s for a display device that has a display area of 1,024×768 pixels, that displays 8-bit, that is, 256-color gradation, and that has a refresh rate of 70 Hz.

The video data transfer amount that can be assigned for the high-speed updating of the screen by the graphic engine (the graphic engine/CPU band width: MB/s) is thus 40 MB/s.

Table 1 indicates the following matters:

1. The use of the faster DRAM provides a memory band width 1.4 times that of the DRAM having a normal transfer rate. The band width available to the graphic engine thus doubles, but manufacturing costs increase 1.5 times to twice instead.
2. The use of the VRAM that is a dual port memory enables the band width for the engine to increase about 2.5 times, but manufacturing costs double instead.
3. If the number of memory data buses is increased to form a DRAM with a data width of 64 bits, a transfer rate twice that of a 32-bit DRAM can be obtained. The band width for the graphic engine thus increases 3.5 times, but manufacturing costs also double.

All these methods tend to increase power consumption, and cannot be adopted now due to demands for reduced manufacturing costs and power consumption.

BRIEF STATEMENT OF THE INVENTION

It is a purpose of this invention to provide a video graphic control method capable of increasing the bandwidth available to the graphic engine without increasing power consumption.

It is another purpose of this invention to provide a video graphic controller capable of increasing the bandwidth available to the graphic engine without increasing production cost.

It is yet another purpose of this invention to provide a video graphic controller capable of increasing the bandwidth available to the graphic engine even when used with a conventional frame memory.

The above purposes are achieved by a video graphic control method for controlling video data by storing the video data from a processing device in a frame memory and causing the frame memory to output the data to a display device, comprising the steps of comparing a piece of video data stored in the N-th address of the frame memory to another piece of video data stored in the M-th address where M is smaller than N, in order to determine whether the two pieces of data match; and if the two pieces of data match, outputting to the display device the piece of video data stored in the M-th address instead of the piece of video data stored in the N-th address.

The above purposes are also achieved by providing a flag that is set if the two pieces of video data match, so as to correspond to the N-th address; and when reading the video data from the frame memory, causing the piece of video data stored in the M-th address to be output to the display device without accessing the piece of video data stored in the N-th address for which the flag has been set.

The above purposes are also achieved by a video graphic controller provided between a processing device for outputting video data to be displayed on the video graphic controller and a frame memory for storing the output video data, characterized in that the controller comprises video data comparitor for comparing a piece of video data stored in the N-th address of the frame memory to another piece of video data stored in the M-th address where M is smaller than N, in order to determine whether the two pieces of data match; and a flag table for setting a flag corresponding to the N-th address if the two pieces of video data match.

The above purposes are also achieved by a video graphic controller characterized in that the controller includes a flag table for setting a flag corresponding to the N-th address if the two pieces of video data match; and a controller operable when reading the video data from the frame memory, to cause the piece of video data stored in the M-th address to be output to the display device without accessing the piece of video data stored in the N-th address for which the flag has been set.

BRIEF DESCRIPTION OF THE DRAWINGS

Some of the purposes of the invention having been stated, others will appear as the description proceeds, when taken in connection with the accompanying drawings, in which.

DESCRIPTION OF THE PREFERRED EMBODIMENT(S)

Figure 1:
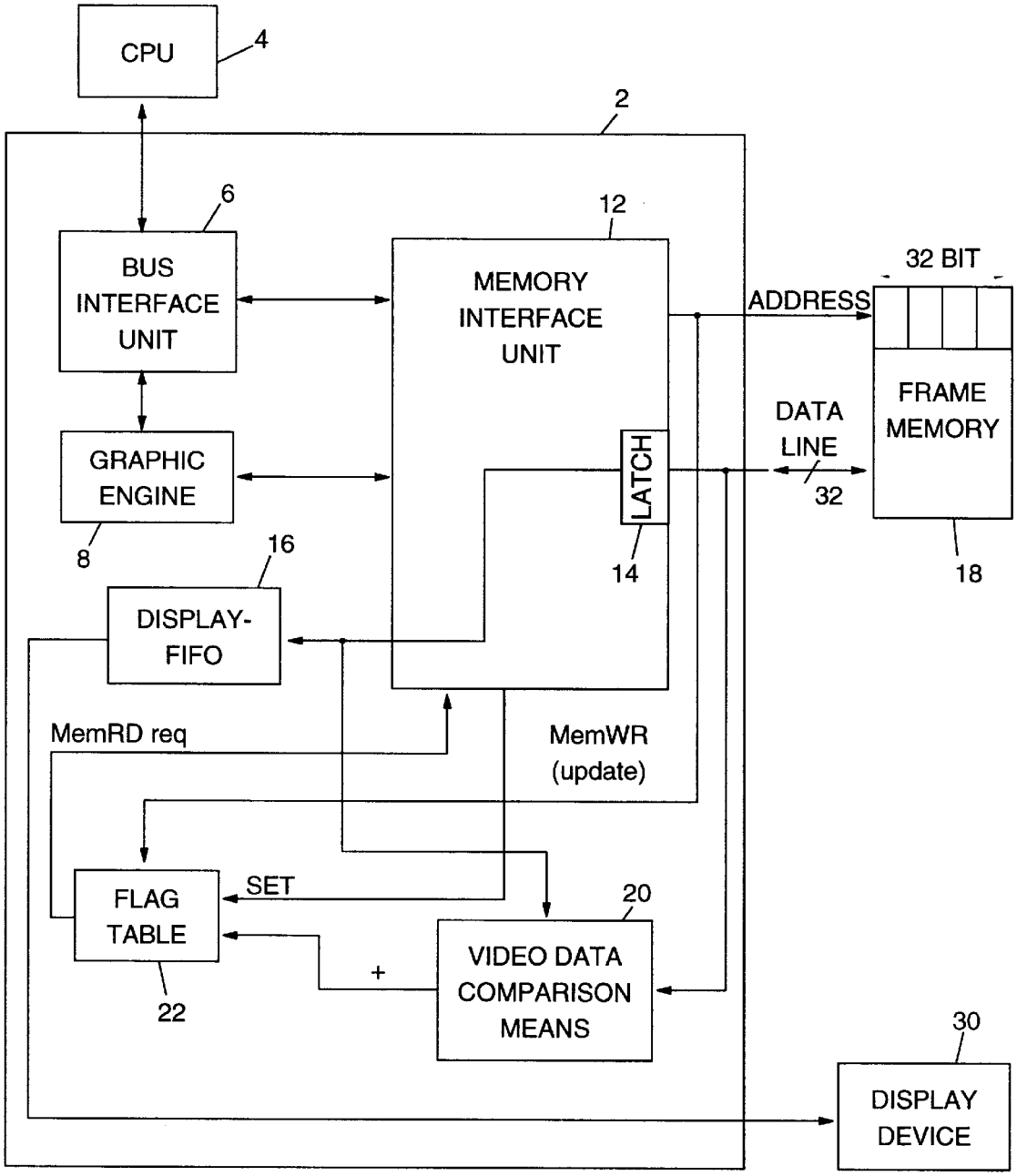
FIG. 1 illustrates a video graphic controller according to the first embodiment of this invention.

While the present invention will be described more fully hereinafter with reference to the accompanying drawings, in which preferred embodiments of the present invention are shown, it is to be understood at the outset of the description which follows that persons of skill in the appropriate arts may modify the inventions here described while still achieving the favorable results of these inventions. Accordingly, the description which follows is to be understood as being a broad, teaching disclosure directed to persons of skill in the appropriate arts, and not as limiting upon the present inventions.

This invention compares a piece of video data stored in the N-th address of the frame memory to another piece of video data stored in the M-th address where M is smaller than N, in order to determine whether the two pieces of data match, and if the two pieces of data match, outputs the piece of video data stored in the M-th address instead of the piece of video data stored in the N-th address, thereby enabling the bandwidth available to a graphic engine or CPU to increase using a conventional frame memory.

A video graphic control method and controller according to a first embodiment of this invention is described with reference to FIGS. 1 to 3. In these figures, the same component members as in the conventional video graphic controller described in this specification carry the same reference numerals as this conventional controller to simplify or omit the description.

Figure 2:
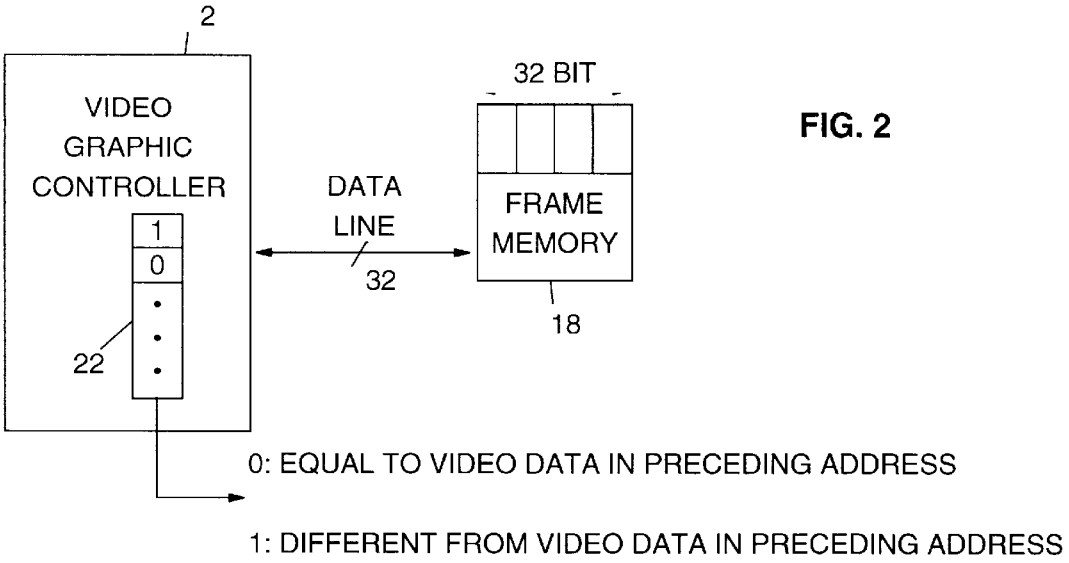
FIG. 2 illustrates the video graphic controller according to the first embodiment of this invention.
Figure 4:
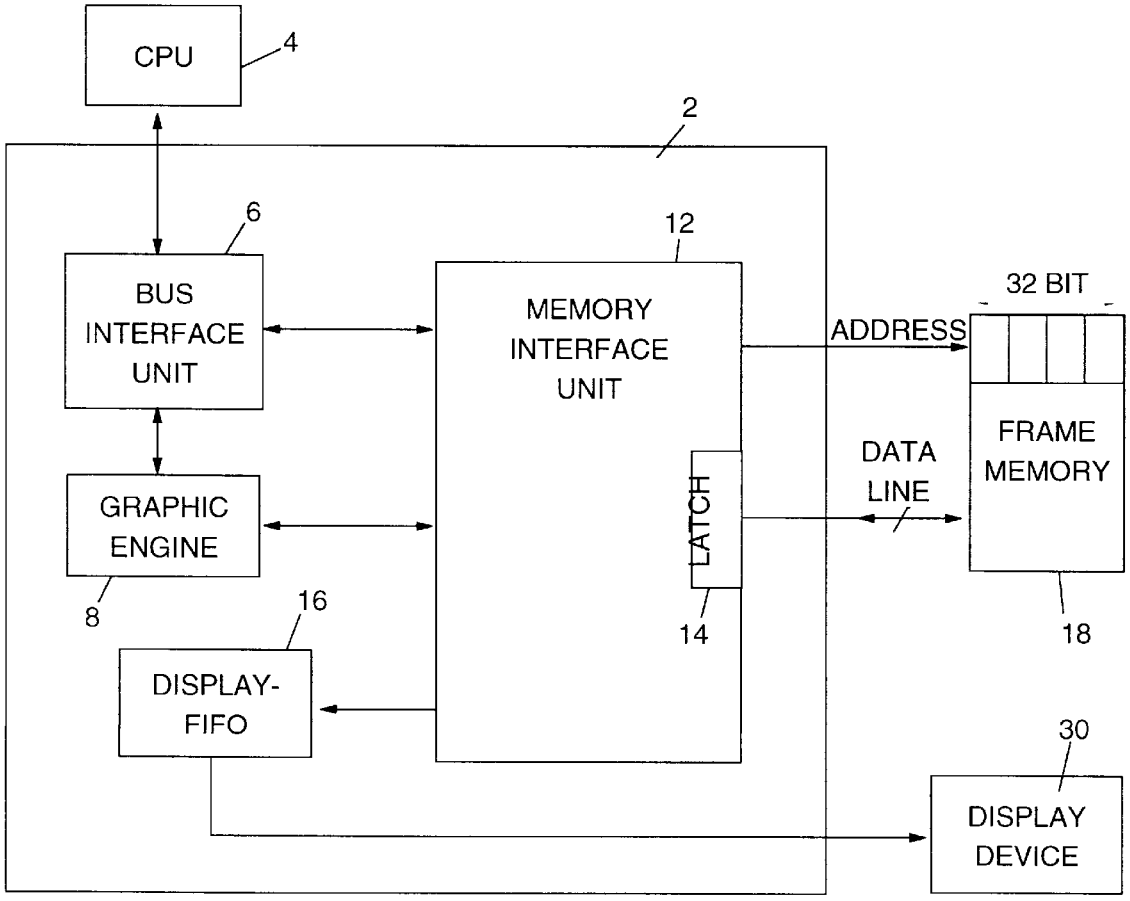
FIG. 4 illustrates a conventional video graphic controller.

FIG. 1 is a schematic block diagram describing the characteristics of a video graphic controller according to this embodiment. Compared to the background art, the video graphic controller according to this invention is characterized by the inclusion of a video data comparison means 2 and a flag table 22.

The video data comparison means 20, here also identified as a comparitor, compares a set of 4 pixels (32 bits) of video data retained in a latch 14 to another set of 4 pixels (32 bits) of video data to be latched next by the latch 14.

The flag table 22 receives address signals sent from a memory interface unit 12 to a frame memory 18.

For example, in an XGA display mode in which 1,024×768 pixels are used for 256-color gradation, the flag table 22 is a register of 24 Kbytes, and each bit in the table is assigned to a different set of 4 pixels (32 bits) of video data in the order of the addresses of the frame memory 18, starting with the leading bit of the table.

Each flag bit in the data table 22 is described in detail with reference to FIG. 2. Each bit in the flag table 22 in the video graphic controller 2 is assigned to a different set of 4 pixels (32 bits) of video data in the frame memory 18 starting with the leading video data therein. If a set of vide data completely matches the preceding set, that is, the adjacent set of video data with a smaller address number, the bit for the former set of video data is set to 0, while otherwise, it is set to 1.

This specifically means that the flag in the flag table 22 is set to 0 if on the display screen of a display device such as a normal LCD, the video data contained in a set of video data in some display position is identical to the video data contained in the set displayed immediately before the first set (that is, the set of video data displayed immediately left to the display position in question if both sets are located on a single line).

Figure 3:
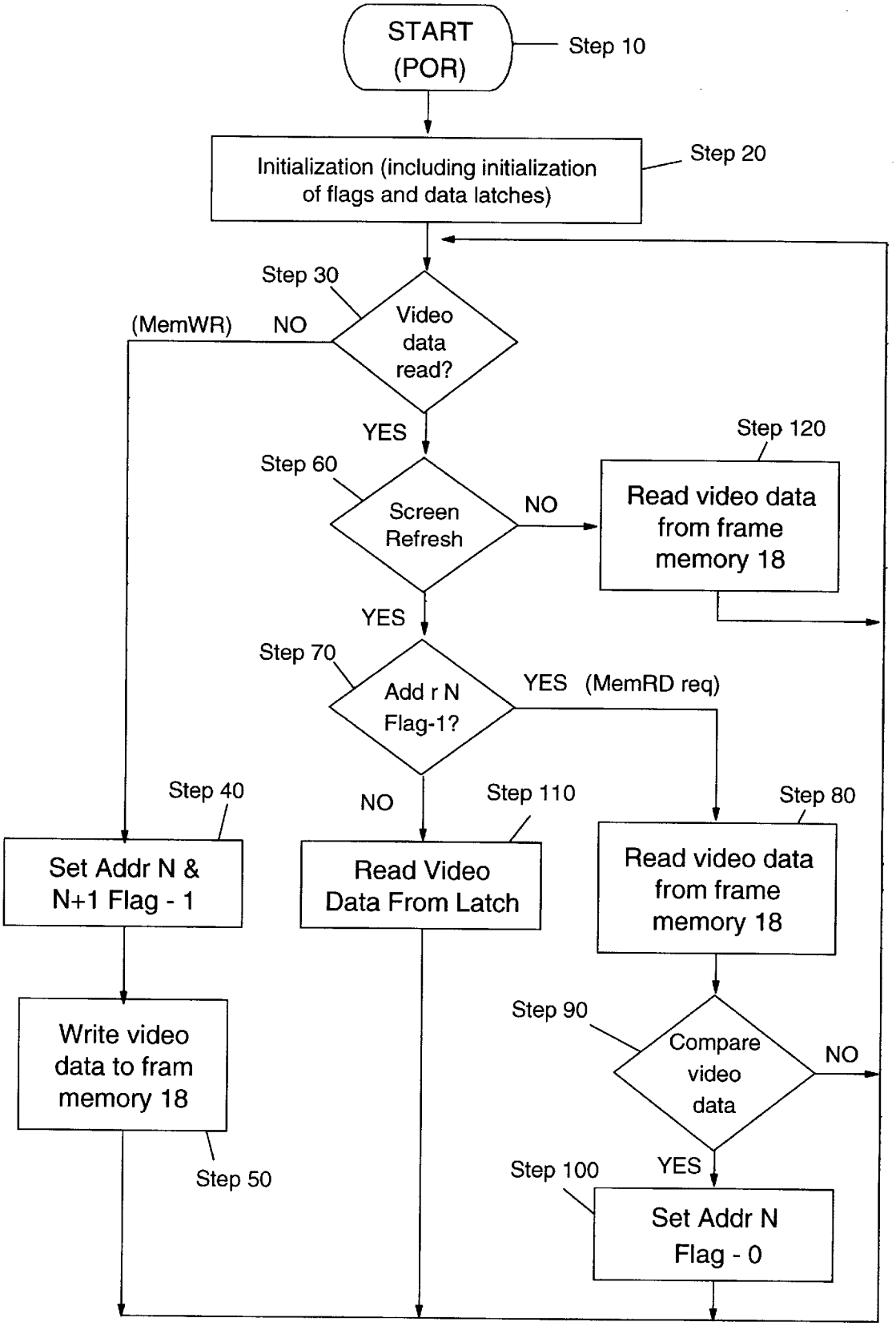
FIG. 3 illustrates a video graphic control method according to the first embodiment of this invention.

Returning to FIG. 1 and also referencing FIG. 3, the video graphic control method and controller according to this embodiment is described.

FIG. 3 is a flowchart showing the video graphic control method according to this embodiment.

The process starts, for example, when the power to the PC is turned on (step 10). When each system of the PC is initialized, the flag table 22 and latch 14 of the video graphic controller 2 according to this embodiment are initialized together with the frame memory 18 (step 20).

Next, it is determined whether the request is to read video data from the frame memory 18 or to write video data thereto (step 30). If the power has just been turned on, however, a video data write request (MemWR) is output from the memory interface unit 12 to the flag table 22, and the process transfers to step 40. At step 40, the bits in the flag table 22 corresponding to the addresses N and N+1 of the frame memory 18 are set to 1. The address N does not correspond to an individual pixel in video data but to a set of 4 pixels (32 bits) of video data.

Although the address N is used for a set of a plurality of (four) pieces of video data, the video graphic control method according to this embodiment is of course applicable to, for example, a single piece of data, so a set of video data is simply called video data for convenience of explanation, unless otherwise specified. The reason why not only the bit in the flag table 22 corresponding to the address N of the memory 18 but also the bit corresponding to the address N+1 are set to 1 is described later.

Subsequently to step 40, specified video data is written to the address N of the frame memory 18 (step 50). The loop from step 30 to step 50 is repeated a required number of times to finish a write to the frame memory 18. By this point of time, all the bits in the flag table 22 have been set to 1.

Next, the video data stored in the frame memory 18 is output to the display device 30. If a read of video data has been requested in step 30, it is then determined whether the request is for screen refresh (step 60). Since, however, video data is output to the screen for the first time, the process transfers to step 70.

At step 60, if the request is not for screen refresh, the process transfers to step 120 to read video data from the frame memory 18. This operation, however, is performed when the request has been issued by the CPU or a graphic engine 8 and has no connection with the flag table 22, so it will not be further described.

At step 70, it is determined whether the bit in the flag table 22 corresponding to the address N for the video data to be read from the frame memory 18 is 1. Since, however, this bit has been set to 1 as described above, the flag table 22 issues a video data read request (MemRD req) to the memory interface unit 12, and the process transfers to step 80 to read video data from the address N of the frame memory 18 and then to place it on a data line connected to the latch 14. The video data comparison means 20 then compares the video data from the address N−1 which has been latched by the latch 14 to the video data from the address N which has been placed on the data line (step 90).

If the value of the video data from the address N and the value of the video data from the address N−1 do not match, the former data is latched by the latch 14, the corresponding bit in the flag table remains 1, and the process returns to step 30. The leading bit in the flag table corresponding to the address 1, that is, the leading address is always 1.

If the value of the video data from the address N and the value of the video data from the address N−1 match, the process proceeds to step 100 to change to 0 the bit in the flag table 22 corresponding to the address N, and then returns to step 30. If the values of the video data match, then the controller of this invention is operable to cause the piece of video data stored at the M-th address (here specifically the N−1 address) to be output to the associated display without accessing the piece of data stored at the N-th address for which a flag has been set.

A read of the first frame out to the display area (the screen) of the display device 30 is finished by repeating step 30 to step 90 or 100 a required number of times. By this point of time, the contents of some bits in the flag table 22 have been changed to 0 although all the bits were previously set to 1.

Next, the flow of a second and subsequent processes in which the request is for screen refresh is described separately in the case in which video data is not updated and in the case in which video data is updated.

First, if video data is not updated, steps 30 to 70 are executed, and it is determined at step 70 whether the flag is 1 or 0. If the flag is 1, a video data read request (MemRD req) is issued to the memory interface unit 12, and the process proceeds to step 80 to read video data from the address N of the frame memory 18, which is then latched by the latch 14 (step 90). The process then returns to step 30.

If it is determined at step 70 that the flag is 0, the video data from the address N matches the video data from the address N−1 which has already been latched. Thus, at step 110, the video data from the address N of the frame memory 18 is prevented from being read, and the video data from the address N−1 which has been retained by the latch 14 is sent to the display device 30 via a display FIFO 16 as video data from the address N. The controller has operated as briefly mentioned above.

A read of a frame out to the display area (the screen) of the display device 30 is finished by repeating step 30 to step 90, 100, or 110 a required number of times.

As described above, since video data in the address for which the corresponding flag is set to 0 is not accessed, the required amount of the display bandwidth that is 60 MB/s as described above can be reduced. Consequently, the memory bandwidth available to the graphic engine 8 can be increased depending upon the number of flags set to 0.

Next, the case in which video data is updated is described.

When the CPU 4 or graphic engine 8 delivers video data to the memory interface unit 12, the unit 12 outputs a video data write request (MemWR (Update)) to the flag table 22, and sets to 1 both two bits corresponding to the addresses N and N+1 of the frame memory 18 (step 40). The memory interface unit 12 then writes video data to the specified address N of the frame memory 18 (step 50).

At step 40, even the bit in the flag table 22 corresponding to the video data in the address N+1 which has not been updated is set to 1. This occurs for the following reason. A flag is set to 0 only when the corresponding video data matches the video data from the preceding address. Thus, once the video data from the preceding address has been updated and changed, the video data in question is not guaranteed to match the data from the preceding address, and the bit corresponding to the video data in question is thus compulsorily set to 1.

Table 2 shows graphic performance obtained using the video graphic control method and controller according to this embodiment compared to a conventional control method.

According to the graphic control method according to this embodiment, the value of the display bandwidth decreases with increasing number of flags set to 0 among the 24 Kbytes of flags in the flag table 22. Thus, according to this embodiment, the display bandwidth varies within the range of 0 to 60 MB/s in theory. If, for example, the overall display area of the display device is displayed in a single color, the display bandwidth is almost 0. Consequently, the bandwidth available to the graphic engine 8 can be determined by subtracting the value of the display bandwidth from the value of the memory bandwidth, that is, 100−0=100 (MB/s). In addition, if the overall display area shows, for example, a landscape, video data sets in the adjacent addresses may rarely match, but even in such a case, a memory bandwidth larger than in conventional graphic control methods is available to the graphic engine 8.

The "Graphic control method according to this embodiment" column in Table 2 shows the display bandwidth (23 MB/s) obtained when VGA data (a landscape) that should be displayed in 640×480 pixels is displayed within a display area of 1024×768 pixels for the XGA display mode, as well as the bandwidth (77 MB/s) available to the graphic engine 8.

TABLE 2

| Memory configuration | 32-bit DRAM | 32-bit DRAM (High Speed) | 32-bit VRAM | 64-bit DRAM | Graphic control method according to this embodiment |
|---|---|---|---|---|---|
| Memory band width (MB/s) | 100 | 140 | 100 | 200 | 100 |
| Display band width (MB/s) (1024 × 768 × 8 × 70 Hz) | 60 | 60 | 60 | 60 | 23 |
| Memory band width available to graphic engine (MB/s) (1024 × 768 × 8 × 70 Hz) | 40 | 80 | 100 | 140 | 77 |
| Cost | 1.0 | 1.5–2.0 | 2.0 | 2.0 | 1.0 |

As described above, this embodiment can increase the bandwidth for the graphic engine 8 as shown in Table 2 simply by providing a simple sequencer based on the flowchart shown in FIG. 3, a register of only about 24 KB acting as the flag table 22, and a video data comparison means. Thus, implementation is very easy and manufacturing costs can be reduced significantly compared to conventional methods.

This invention is not limited to the above embodiment, and various modifications may be made thereto.

For example, although in the above embodiment, a DRAM with a data width of 32 bits has been used as the frame memory, this invention is of course applicable to other storage elements, for example, the high-speed DRAM or DRAM with a 64-bit data bus shown in Table 1, thereby enabling the bandwidth for the graphic engine or CPU to increase as shown in Table 1.

Furthermore, although in the above embodiment, a flag has been set for 32 bits in the data line between the video graphic controller 2 and the frame memory 13, this invention is not limited to this aspect but can be implemented according to arbitrary numbers of gradation data bits and pixels.

In addition, although the flag in the flag table 22 comprises a single bit for an address for video data, a plurality of bits may be assigned to each address. For example, if the display FIFO 16 includes ten stages, a 10-bit flag may be provided for the video data in the address N.

In this case, if any of the ten flags is 0, one of the 10 pieces of video data in the display FIFO 16 matches the video data address N−1–N−10 in the address N, and accesses to the frame memory 18 can be reduced by inputting the matching video data to the buffer 16. As a result, the bandwidth for the graphic engine can further be increased.

As described above, this invention can increase the bandwidth available to a graphic engine or CPU using a conventional frame memory, without increasing power consumption or manufacturing costs.

In the drawings and specifications there has been set forth a preferred embodiment of the invention and, although specific terms are used, the description thus given uses terminology in a generic and descriptive sense only and not for purposes of limitation.

What is claimed is:

1. A method for increasing the video bandwidth of a computer system, the method comprising the steps of:

(a) determining whether the state of a data match flag of first set of video data is in a first state;

(b) responsive to the data match flag of the first set of video data being in the first state, loading the first set of video data into a latch;

(c) comparing a second set of video data to the first set of video data;

(d) responsive to the second set of video data matching the first set of video data, changing the state of a data match flag of the second set of video data from a first state to a second state;

(e) responsive to a screen refresh, determining whether the state of the data match flag of the second set of video data is in the second state; and (f) responsive to the state of the data match flag of the second set of video data being in the second state, outputting the first set of video data to a display device.

2. The method of claim 1 further comprising the steps of:

(a) comparing a third set of video data to the second set of video data;

(b) responsive to the third set of video data matching the second set of video data, changing the state of a data match flag of the third set of video data from a first state to a second state;

(c) responsive to a screen refresh, determining whether the state of the data match flag of the third set of video data is in the second state; and (d) responsive to the state of the data match flag of the third set of video data being in the second state, outputting the first set of video data to a display device.

3. The method of claim 2 further comprising the steps of:

(a) responsive to the third set of video data not matching the second set of video data, placing the data match flag of the third set of video data in a first state;

(b) responsive to a screen refresh, determining whether the state of the data match flag of the third set of video data is in the first state; and (c) responsive to the state of the data match flag of the third set of video data being in the first state, outputting the third set of video data to a display device.

4. A method for increasing the bandwidth of video data transfer in computer systems comprising the steps of:

(a) determining whether the state of a data match flag of first set of video data is in a first state;

(b) responsive to the data match flag of the first set of video data being in the first state, loading the first set of video into a latch;

(c) comparing a plurality of successive sets of next video data to the first set of video data for a match;

(d) for each successive set of next video data which matches the first set of video data, changing the state of the data match flag of each successive set of next video data from a first state to a second state;

(e) outputting the first set of video data to a display device;

(f) comparing the state of the data match flag of each successive set of next video data to determine whether the data match flag is in a second state; and (g) responsive the state of the data match flag of each successive set of next video data being in the second state, outputting the first set of video data to the display device for each such occurrence.

5. A device for increasing the bandwidth of video data transfer in computer systems, the device comprising:

(a) logic for determining whether the state of a data match flag of first set of video data is in a first state;

(b) logic for loading the first set of video data into a latch responsive to the data match flag of the first set of video data being in the first state;

(c) logic for comparing a second set of video data to the first set of video data;

(d) logic for changing the state of a data match flag of the second set of video data from a first state to a second state responsive to the second set of video data matching the first set of video data;

(e) logic for determining whether the state of the data match flag of the second set of video data is in the second state responsive to a screen refresh; and (f) logic for outputting the first set of video data to a display device responsive to the state of the data match flag of the second set of video data being in the second state.

6. The device of claim 5 further comprising:

(a) logic for comparing a third set of video data to the second set of video data;

(b) logic for changing the state of a data match flag of the third set of video data from a first state to a second state responsive to the third set of video data matching the second set of video data;

(c) logic for determining whether the state of the data match flag of the third set of video data is in the second state responsive to a screen refresh; and (d) logic for outputting the first set of video data to a display device responsive to the state of the data match flag of the third set of video data being in the second state.

7. The device of claim 6 further comprising:

(a) logic for placing the data match flag of the third set of video data in a first state responsive to the third set of video data not matching the second set of video data;

(b) logic for determining whether the state of the data match flag of the third set of video data is in the first state responsive to a screen refresh; and (c) logic for outputting the third set of video data to a display device responsive to the state of the data match flag of the third set of video data being in the first state.

8. A video controller for transferring video data to a display device, the controller comprising:

(a) logic for determining whether the state of a data match flag of a first set of video data is in a first state;

(b) logic for loading the first set of video into a latch responsive to the data match flag of the first set of video data being in the first state;

(c) logic for comparing a plurality of successive sets of next video data to the first set of video data for a match;

(d) logic for changing the state of the data match flag of each successive set of next video data from a first state to a second state for each successive set of next video data which matches the first set of video data;

(e) logic for outputting the first set of video data to a display device;

(f) logic for comparing the state of the data match flag of each successive set of next video data to determine whether the data match flag is in a second state; and (g) logic for outputting the first set of video data to the display device for each occurrence of the state of the data match flag of each successive set of next video data being in the second state.

* * * * *